US006836966B2

(12) United States Patent
Patrick

(10) Patent No.: US 6,836,966 B2
(45) Date of Patent: Jan. 4, 2005

(54) HEATED RAZOR AND ELECTRIC SHAVER

(75) Inventor: John Patrick, Fort Myers, FL (US)

(73) Assignee: SLE Limited Partnership, Midlothian, VA (US)

( * ) Notice: Subject to any disclaimer, the term of this patent is extended or adjusted under 35 U.S.C. 154(b) by 0 days.

(21) Appl. No.: 10/455,705

(22) Filed: Jun. 5, 2003

(65) Prior Publication Data

US 2003/0226258 A1 Dec. 11, 2003

Related U.S. Application Data

(60) Provisional application No. 60/386,345, filed on Jun. 6, 2002.

(51) Int. Cl.[7] ..... B26B 19/48
(52) U.S. Cl. ..... 30/34.05; 30/140
(58) Field of Search ..... 30/34.05, 43.4, 30/43.5, 43.6, 43.7, 43.8, 43.9, 140

(56) References Cited

U.S. PATENT DOCUMENTS

| | | | | |
|---|---|---|---|---|
| 1,552,026 A | | 9/1925 | Barra | 30/34.05 |
| 2,063,808 A | | 12/1936 | Henderson et al. | 30/34.05 |
| 2,225,257 A | * | 12/1940 | Conill | 30/34.05 |
| 2,324,148 A | | 7/1943 | Gravin | 30/34.05 |
| 2,622,319 A | | 12/1952 | Hunt | 30/34.05 |
| 3,610,080 A | | 10/1971 | Kuris | 30/45 |
| 4,253,013 A | | 2/1981 | Mabuchi | 219/521 |
| 4,547,392 A | * | 10/1985 | Majima et al. | 427/533 |
| 5,065,515 A | | 11/1991 | Iderosa | 30/140 |
| 5,394,777 A | | 3/1995 | Kozikowski | 30/34.05 |
| 5,533,266 A | | 7/1996 | Kelman | 30/140 |
| 5,653,025 A | | 8/1997 | Cheng et al. | 30/140 |
| 5,973,294 A | * | 10/1999 | Schatt et al. | 30/140 |
| 6,014,918 A | | 1/2000 | Orloff | 30/34.05 |
| 6,367,155 B2 | * | 4/2002 | Homann | 30/140 |

FOREIGN PATENT DOCUMENTS

| | | |
|---|---|---|
| FR | 2 703 290 | * 10/1994 |
| FR | 2 721 247 | 12/1995 |

* cited by examiner

*Primary Examiner*—Hwei-Siu Payer
(74) *Attorney, Agent, or Firm*—Fay, Sharpe, Fagan, Minnich & McKee, LLP

(57) ABSTRACT

A shaver (10) includes a razor blade (20*a*, 20*b*) that cuts hairs coming into contact therewith. A heating element (26*a*, 26*b*) is bonded to the razor blade (20*a*, 20*b*). The heating element (26*a*, 26*b*) generates heat when an electric current is passed therethrough, the generated heat being directly supplied to the razor blade (20*a*, 20*b*). A battery (32) generates electric current, and electrical conductors (28, 30, 50, 52) route electric current generated by the battery (32) to the heating element (26*a*, 26*b*). A handle (16) is adapted to be held by a user for manipulation of the shaver (10). Suitably, the handle (16) houses the battery (32), and a head (12) houses the razor blade (20*a*, 20*b*) and heating element (26*a*, 26*b*) bonded thereto, the head (12) being selectively attachable to and detachable from the handle (16).

16 Claims, 7 Drawing Sheets

HEATED RAZOR AND ELECTRIC SHAVER

This application claims the benefit of U.S. Provisional Application No. 60/386,345, filed Jun. 6, 2002, incorporated herein by reference in its entirety.

BACKGROUND

The present invention relates to shaving devices. It finds particular application in conjunction with a shaving device having heated blades, and will be described with particular reference thereto. It is to be appreciated, however, that the invention is also amenable to other like applications.

In a typical blade shaving process, the cutting edge of the blade is drawn across the skin surface to cut hair that is in the path of the blade. Because hair is more easily cut when it is heated, it is desirable to have a means to heat or otherwise soften hair for ease of cutting. Additionally, a more flexible cutting blade as is achieved when the blade is heated also tends to improve shaving.

Typically, when a manual or safety razor is used, a hair softening agent, such as, shaving cream or lotion, is applied to the shaving surface. While shaving cream is effective for softening hair, it can be messy, inconvenient, and prone to reduce the advantages of a heated shave.

Some prior art shaving devices have attempted to heat the blades by heating the entire razor head and relying on thermal conduction to heat the blades. This method is rather inefficient as well as potentially dangerous if the entire razor head is heated to such a temperature that the user may be injured. Further, these conventional razors lack a means to control the heating of the blades. Other prior art devices, such as FR 2721247 to Perolini, have included heated metal parts adjacent to blades in order to conduct heat to the blades. Again, this method is rather inefficient and lacks the means to control blade temperature.

The present invention contemplates a new and improved heated shaving device which overcomes the above-referenced problems and others.

SUMMARY

In accordance with one aspect of the present invention, a shaver is provided. The shaver includes: a razor blade that cuts hairs coming into contact therewith; a heating element bonded to the razor blade, the heating element generating heat when an electric current is passed therethrough, the heat being supplied to the razor blade; a battery that generates electric current; electrical conductors through which electric current generated by the battery is routed to the heating element; a handle adapted to be held by a user for manipulation of the shaver, said handle housing the battery; and, a head that houses the razor blade and heating element bonded thereto, said head being selectively attachable to and detachable from the handle.

In accordance with another aspect of the present invention, a shaving device includes: cutting means for cutting hairs coming into contact therewith; heating means for supplying heat to the cutting means when energized; and, powering means for selectively supplying power to the heating means thereby energizing the same.

One advantage of the present invention is that it optionally provides a heated shave that is generally an improvement over a non-heated shave.

Another advantage of the present invention is that it optionally provides efficient heating via direct application of heat to the shaver's cutting element or razor blade.

Yet another advantage of the present invention is that it optionally senses and provides temperature feedback which is used to regulate heating so as to substantially maintain the temperature at a set level or within a determined range.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention. Note, the drawings are not to scale.

DETAILED DESCRIPTION OF PREFERRED EMBODIMENTS

Figure 1:
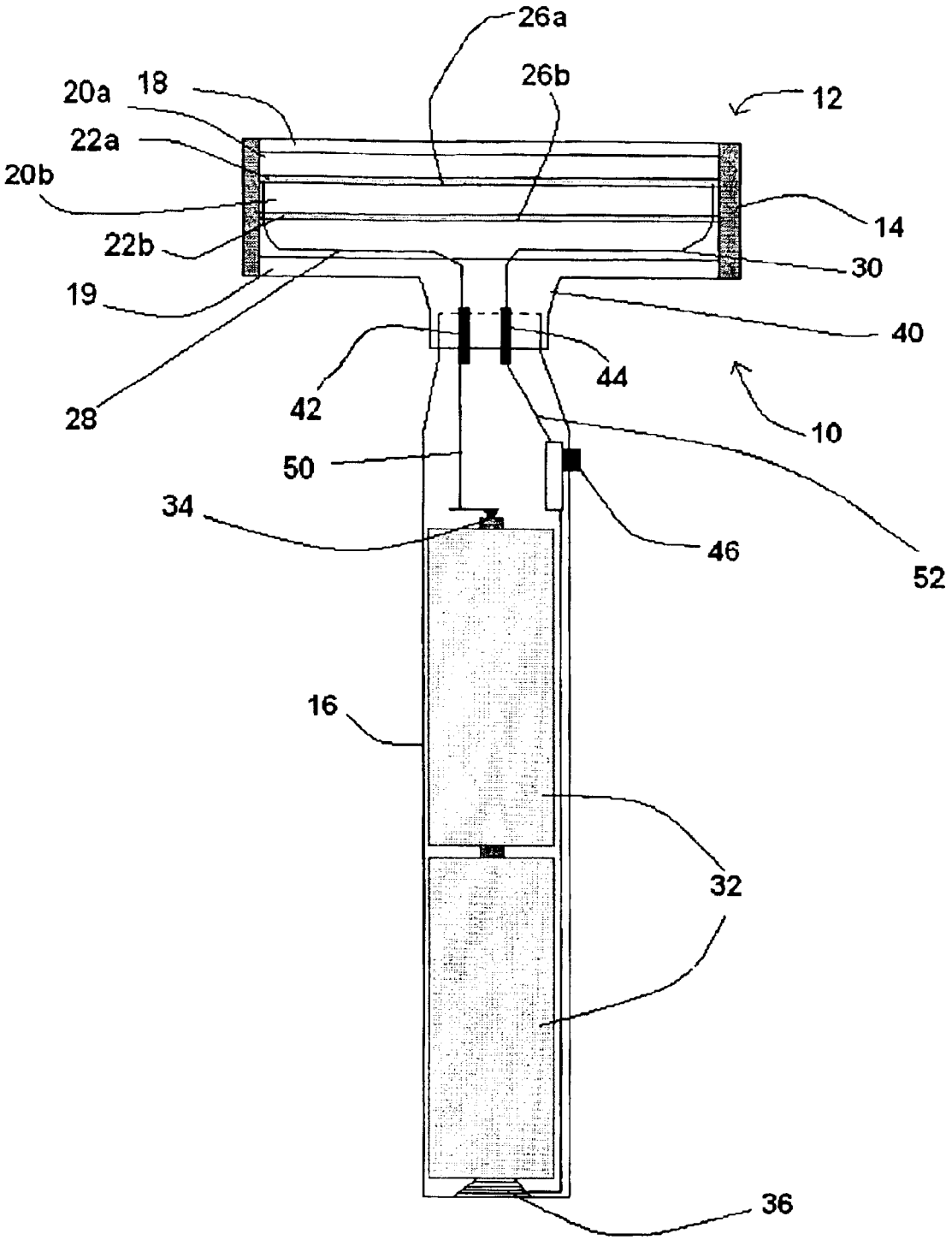
FIG. 1 is a diagrammatic illustration showing a cross-section view of an exemplary heated manual razor in accordance with aspects of the present invention.

Referring now to the drawings wherein the showings are made for purposes of illustrating preferred embodiments of the invention only and not for limiting the same, FIG. 1 illustrates a heated manual razor 10, which includes a removable razor head 12 attached to one end of a handle 16. The razor head 12 includes a blade housing 14 having an upper guard bar 18 and a lower guard bar 19. One or more blades 20*a*, 20*b* are mounted in parallel on the housing 14 between the guard bars 18, 19. Each blade 20*a*, 20*b* includes a cutting edge 22*a*, 22*b* for cutting facial or other body hair.

Figure 2:
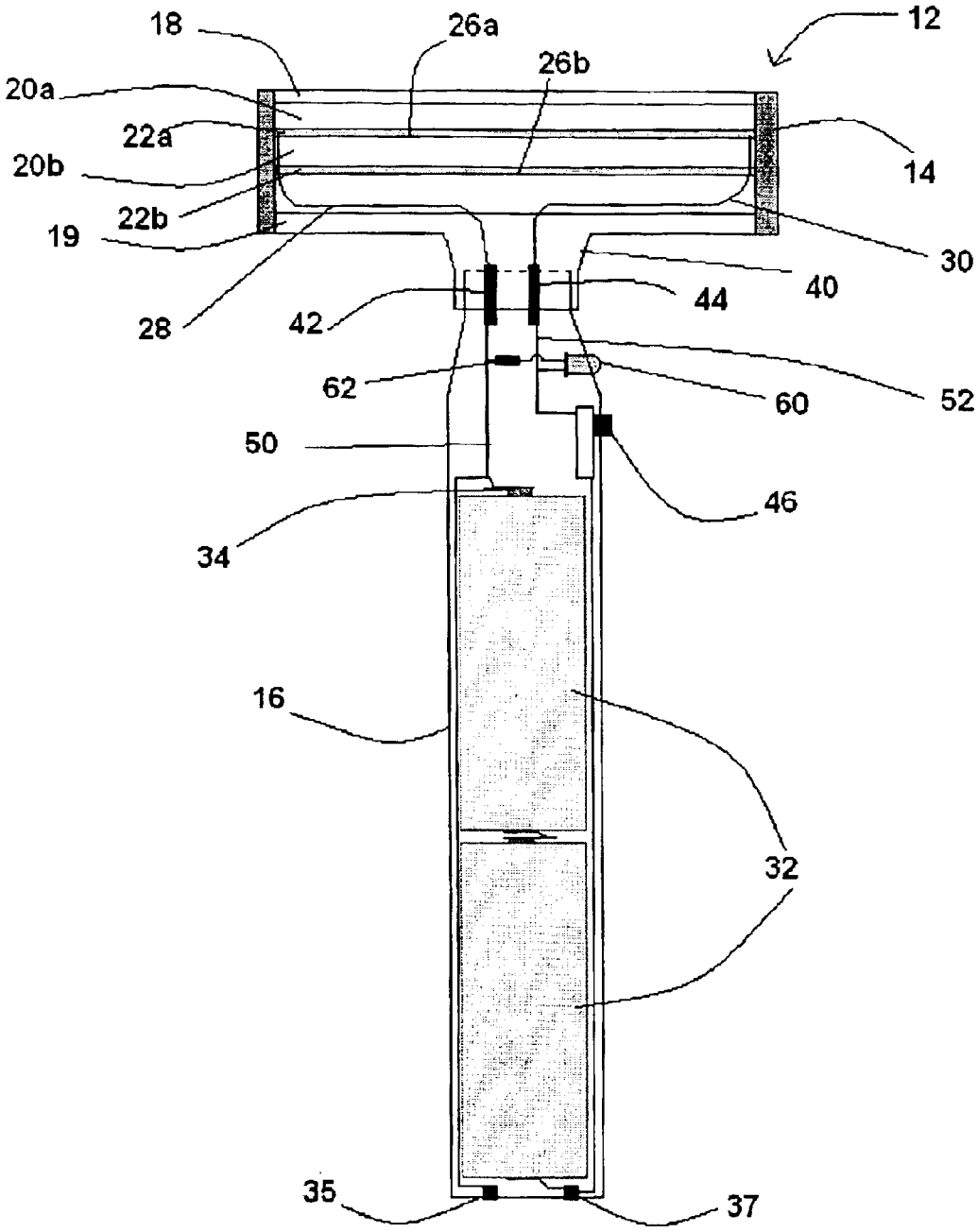
FIG. 2 is a diagrammatic illustration showing a cross-section view of another embodiment of an exemplary heated manual razor in accordance with aspects of the present invention.
Figure 3:
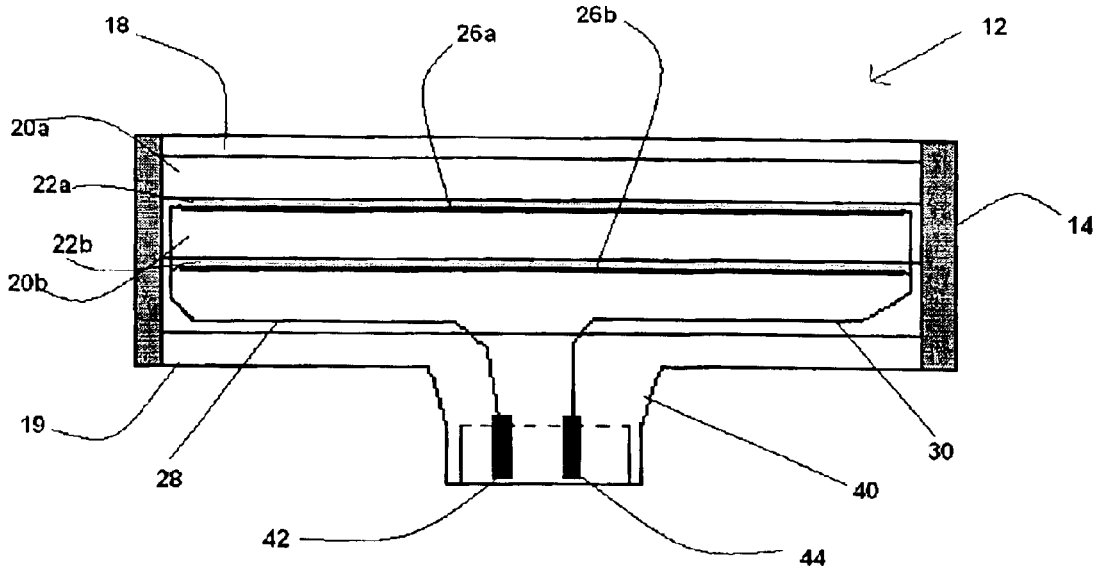
FIG. 3 is a diagrammatic illustration showing a view of a head of the heated manual razor illustrated in FIGS. 1 and 2.

As shown in FIG. 3, where like reference numerals refer to like elements, each blade 20*a*, 20*b* includes a heating element 26*a*, 26*b* bonded or otherwise secured thereto. In one embodiment, each heating element is a thin heating element, which is bonded directly to the underside of each blade along substantially the entire length of the blade using an adhesive or epoxy that has properties of good thermal conductivity, while still providing electrical isolation. Alternately, each heating element is bonded or otherwise attached to each blade by means of spot welding, depending upon the choice of heating element. Of course, other alternate methods of direct bonding or fusing as are known may be employed. In another embodiment, the blade itself serves as the heat dissipating element by making the blade from an appropriate composite material. In order to heat the blades, power is supplied to each of the heating elements 26*a*, 26*b* via a pair of electrical conductors 28, 30 in electrical contact with the heating elements. As voltage is applied to each of the resistive heating elements, current passes through the heating elements, which results in an increase in temperature of the heating element and blade to which the heating element is bonded. In one embodiment, illustrated in FIGS. 1–3, the heating elements are self-regulated heating elements, such as thermistors and the like. Alternately, as is discussed more fully below, the heating elements are controlled by an electronic power regulator. The heating elements are operative to heat the blades to a temperature within a range of 50–200 degrees Fahrenheit, as desired by an operator. Preferably, the blades are heated to a temperature of 110–125 degrees Fahrenheit for maximum performance and comfort for the operator.

As discussed above, the razor head 12 is removably attached to the handle 16 via a watertight seal, such as an O-ring or the like. Preferably, the handle 16 is hollow and houses one or more batteries 32 or other sources of power. In one embodiment, the handle includes a positive and negative electrical contact 34, 36 which are in electrical contact with a pair of 1.5V dry cell or rechargeable batteries, more commonly known as AA batteries. However, it is to be appreciated that batteries of varying size and voltage as well as other power sources may be employed.

The razor head 12 includes a neck portion 40, which houses a plug having a pair of electrical contacts 42, 44. The electrical contacts are detachably engaged to a pair of corresponding electrical contacts within the handle. Accordingly, a new razor head may be conveniently installed once the blades of the prior head become dull and worn. The electrical contacts 42, 44 are in electrical communication with the electrical conductors 28, 30 within the head and facilitate electrical communication between the electrical conductors 28, 30 and corresponding electrical conductors 50, 52 within the handle 16. Preferably, the handle 16 includes an on/off switch 46 for selectively applying power through electrical conductors 50, 52 to the heating elements.

Figure 6:
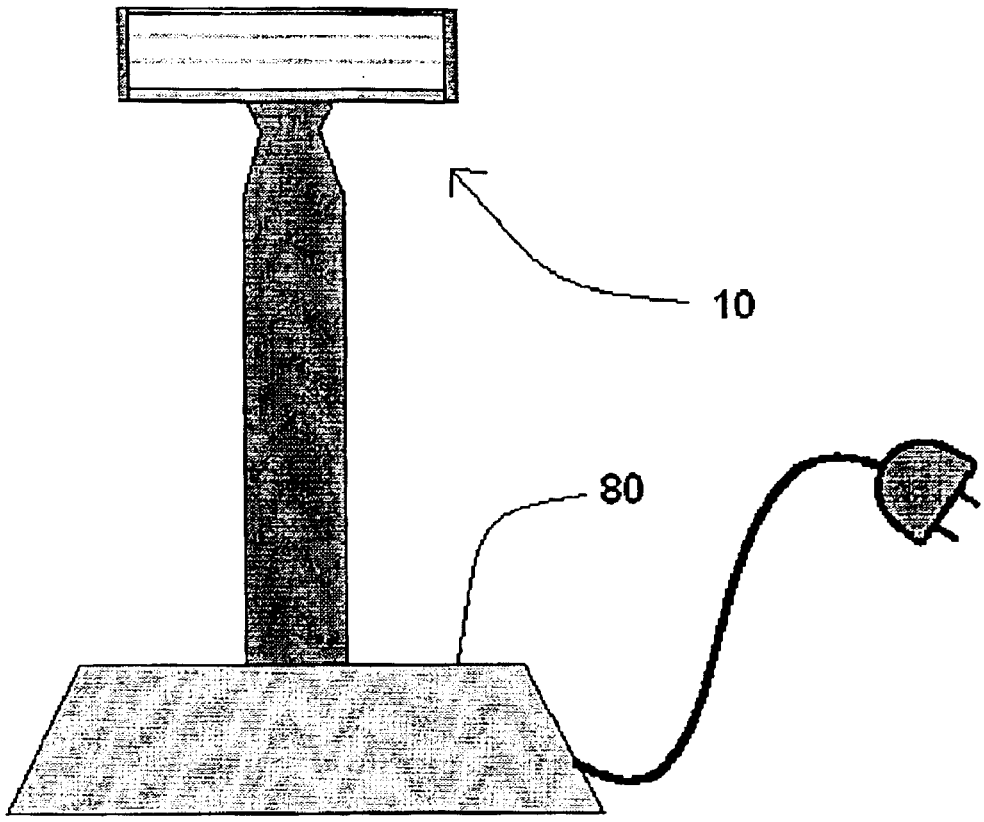
FIG. 6 is a diagrammatic illustration showing a view of an exemplary heated manual razor disposed within a battery charger in accordance with aspects of the present invention.

As shown in FIG. 2, where like reference numerals refer to like elements, in an embodiment in which rechargeable batteries 32 are employed as the power source, the handle 16 includes a pair of battery charging electrical connectors 35, 37. Artisans will appreciate that in this embodiment, the razor 10 may be periodically recharged using a standard battery charger 80 (illustrated in FIG. 6). In one embodiment, the razor includes a battery status indicator, which comprises and indicator light 60, such as a light emitting diode (LED) and the like, and a resistor 62 or other current limiting means associated with the indicator light 60. Preferably, the indicator light will remain lit whenever the on/off switch 46 is in the ON position, until the battery voltage is depleted to the point where it can no longer provide sufficient power to maintain the blade(s) within the desired temperature range.

Figure 4:
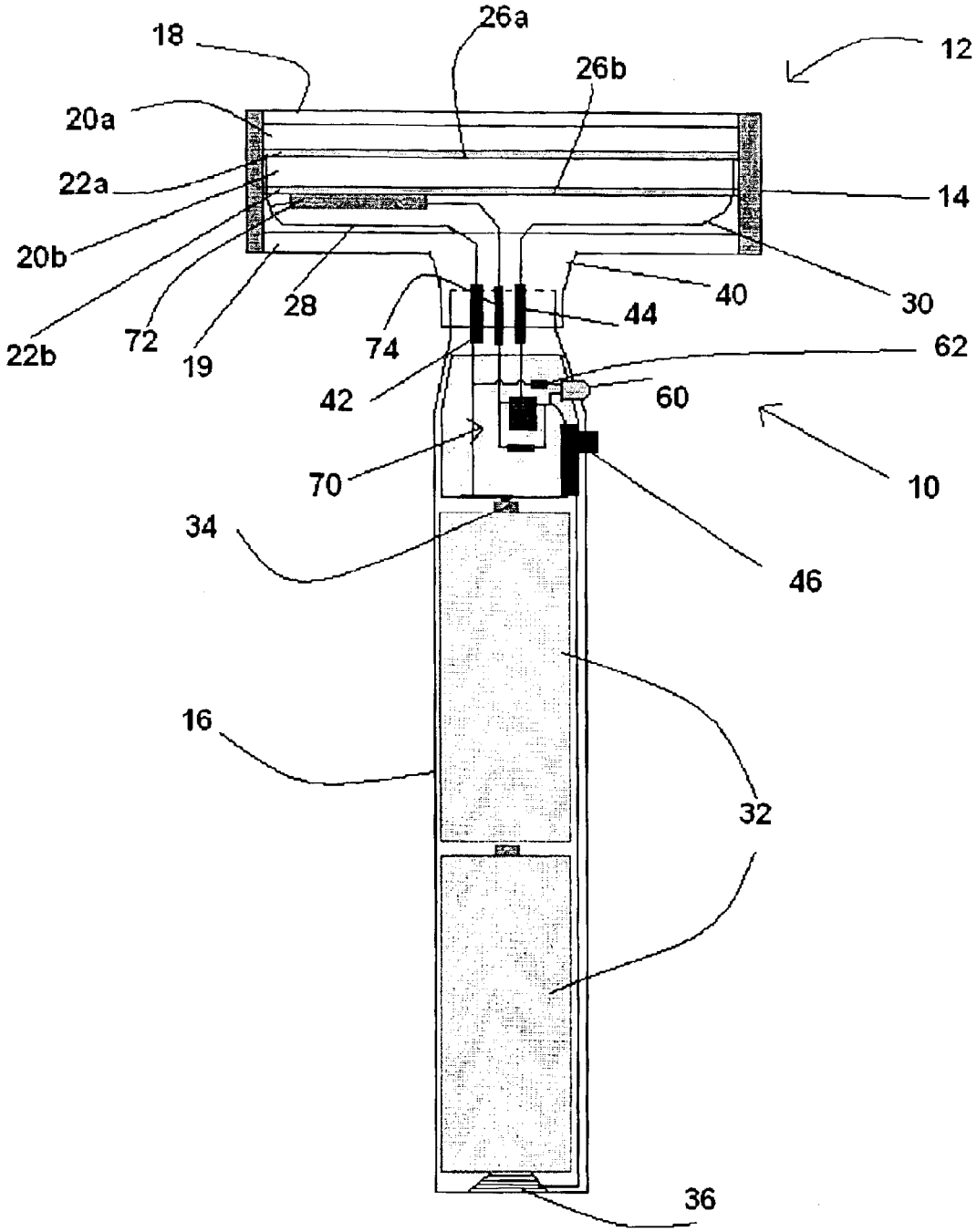
FIG. 4 is a diagrammatic illustration showing a cross-section view an exemplary heated manual razor including temperature feedback control in accordance with aspects of the present invention.
Figure 5:
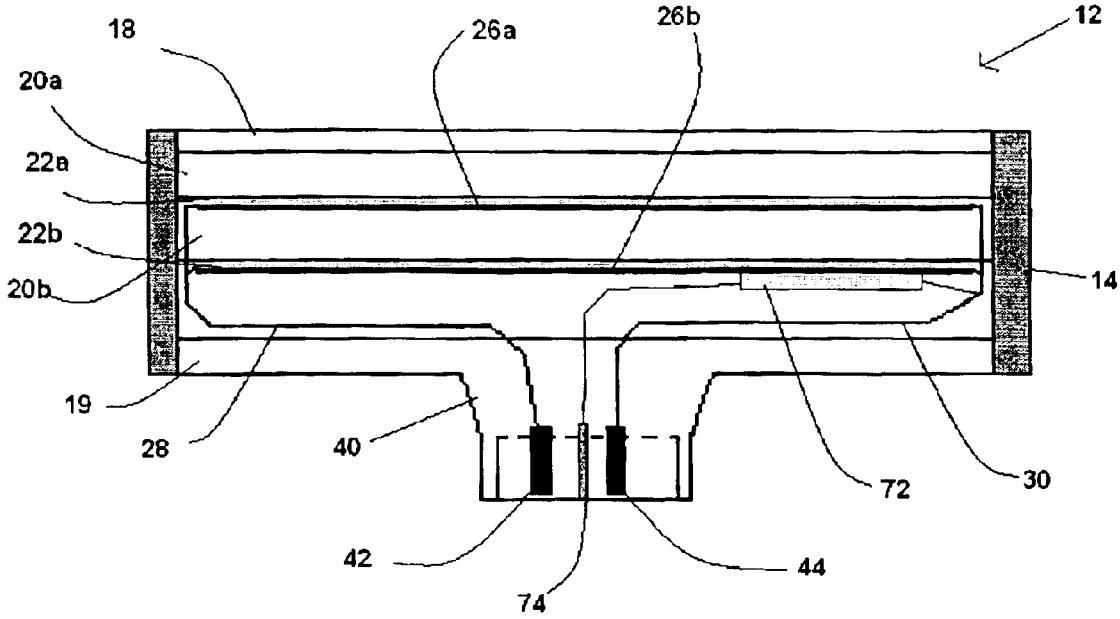
FIG. 5 is a diagrammatic illustration showing a view of a head of the heated manual razor illustrated in FIG. 4.

FIGS. 4 and 5 show an alternate embodiment of the heated manual razor 10. For convenience, elements of the embodiment illustrated in FIGS. 4 and 5, which are like elements shown in FIGS. 1, 2 and 3 have common reference numerals, while new elements are designated by new reference numerals. As stated above, in one embodiment, the heating elements 26*a*, 26*b* are controlled by a power regulator in communication with a temperature control circuit 70. More particularly, the razor head 12 includes at least one temperature sensor 72 bonded to at least one of the blades 20*a*, 20*b*. The temperature sensor 72 senses the temperature of the blades and transmits this data along an electrical conductor through temperature control contact 74 to the temperature control circuit 70. The temperature control circuit 70 compares this temperature data to a pre-selected value and adjusts the power supplied to the heating elements 26*a*, 26*b* such that a desired blade temperature is maintained. As discussed above, the heating elements 26*a*, 26*b*, under control of the power regulator and temperature control circuit 70, are operative to heat the blades to a temperature within a range of 100–140 degrees Fahrenheit. Preferably, the blades are heated to a temperature of 110–125 degrees Fahrenheit for maximum performance and comfort for the operator. In one embodiment, the temperature set point is operator selectable by means of a multi-position dial, which allows the operator to select low, medium or high temperatures within the available temperature range.

Figure 7:
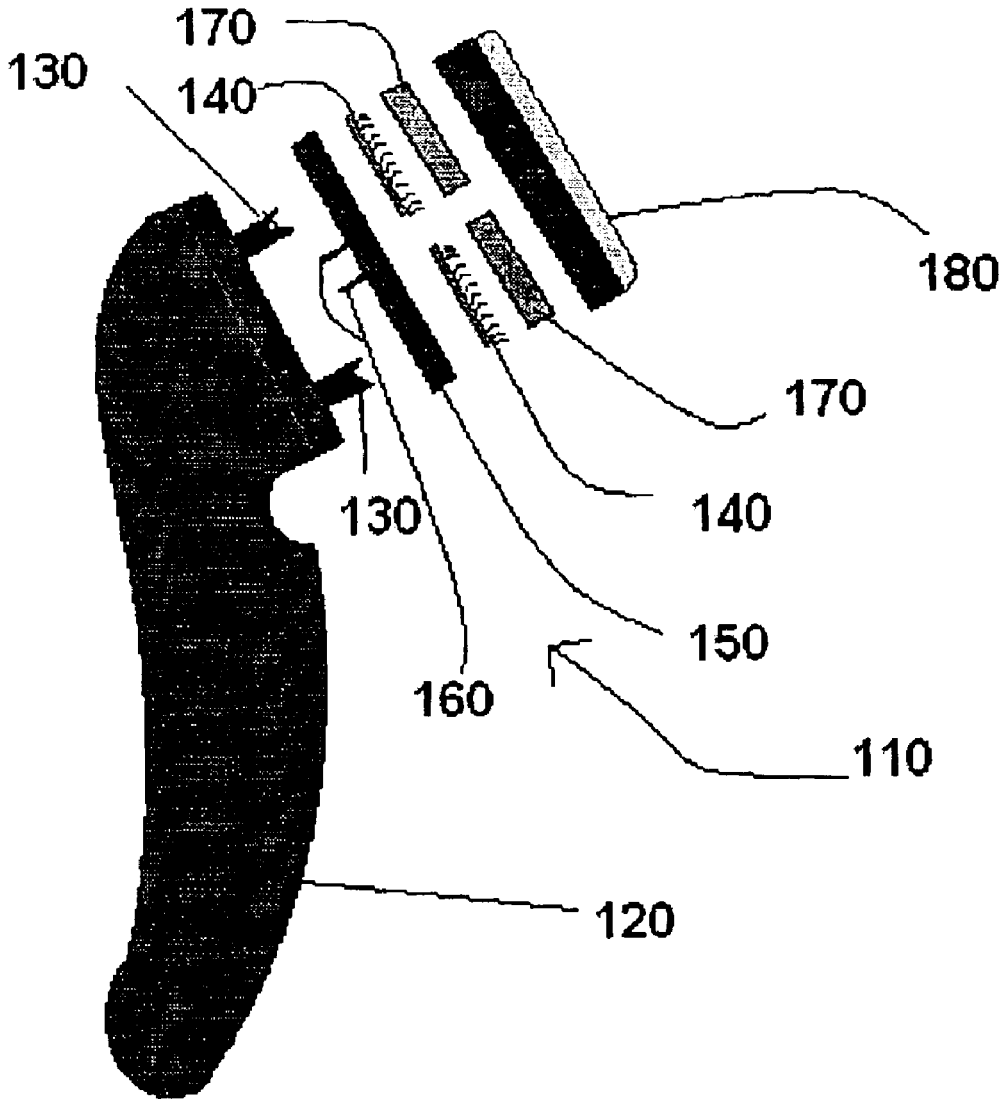
FIG. 7 is a diagrammatic illustration showing an exploded view of an exemplary heated electric shaver in accordance with aspects of the present invention.

With reference now to FIG. 7, in another embodiment, an electric shaver 110 includes a body portion 120, which, as artisans will appreciate, includes batteries, rechargeable or otherwise, motors, and controls. The shaver includes one or more blade drives 130 for driving one or more rotary or oscillating blades 140. The rotary blades are housed or otherwise supported by a rotary blade retainer 150. The rotary blade retainer 150 includes one or more heating elements, which are powered by the shaver battery or power supply via one or more electrical contacts 160. In this embodiment, the heating elements do not make physical contact with the rotary blades. The heating elements may be self-regulating elements or may be controlled by a power regulator and temperature control circuit. The shaver further includes one or more rotary blade covers 170 and a cutting head cover 180. In an alternate embodiment, an infrared heat source or other heat source such as a laser may be employed to heat the rotary blades. In one embodiment, the rotary blade retainer 150 houses or otherwise supports a source of usable infrared energy, such as a heating element comprised of Ni-chrome, tungsten or another suitable material. The infrared energy source is suspended over an infrared reflective background suitable for radiating and directing the infrared energy to the rotating blades 140, thereby heating the blades. Preferably, the underside of the rotating blades 140 includes an infrared-absorbing coating, such as a flat black coating or the like.

It is to be appreciated that in connection with the particular exemplary embodiments presented herein certain structural and/or function features are described as being incorporated in defined elements and/or components. However, it is contemplated that these features may similarly be incorporated in other elements and/or components. Further, different aspects of the exemplary embodiments may be selectively mixed and matched as appropriate to achieve other alternate embodiments suited for desired applications, the other alternate embodiments thereby realizing the respective advantages of the aspects incorporated therein.

Additionally, it is to be appreciated that certain elements described herein as incorporated together may under suitable circumstances be stand alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described herein as distinct from one another may be physically or functionally combined where appropriate.

In short, the invention has been described with reference to preferred embodiments. Obviously, modifications and alterations will occur to others upon reading and understanding the present specification. It is intended that the invention be construed as including all such modifications and alterations insofar as they come within the scope of the appended claims or the equivalents thereof.

What is claimed is:

1. A shaving device comprising:

a handle by which a user manipulates the shaving device;

a razor blade;

a heating element bonded to the razor blade, said heating element generating heat in response to electric power being supplied thereto;

a head detachably connected to the handle, said head containing the razor blade;

electric supply means for selectively supplying electric power to the heating element, wherein said electric supply means is housed in the handle;

a first pair of electrical contacts arranged in the head in electrical communication with the heating element; and, a second pair of electrical contacts arranged in the handle in electrical communication with the electric supply means, said second pair of electrical contacts engaging with said first pair of electrical contacts when the head is attached to the handle to provide an electrical connection between the electric supply means and the heating element.

2. A shaving device comprising:

cutting means for cutting hairs coming into contact therewith, said cutting means comprising a razor blade;

heating means for supplying heat to the cutting means when energized, said heating means comprising a resistive heating element bonded to the razor blade, said resistive heating element generating heat in response to an electric current passing therethrough;

a handle by which a user manipulates the shaving device;

generating means for generating electric power that is supplied to the heating means thereby energizing the same, said generating means being housed in the handle;

a head which is selectively attachable to and detachable from the handle, said head housing the cutting means and the heating means; and, power transfer means for transferring power generated by the generating means from the handle to the head when the head is attached to the handle.

3. The shaving device of claim 2, wherein the generating means comprises a battery.

4. The shaving device of claim 3, further comprising:

indicating means for providing a human perceivable indication of an amount of electric power available from the battery.

5. The shaving device of claim 2, further comprising:

sensing means for detecting a temperature of the cutting means.

6. The shaving device of claim 5, further comprising:

regulating means for regulating the electric power supplied to the heating means from the generating means based upon the temperature detected by the sensing means.

7. The shaving device of claim 6, wherein the regulating means comprises an electric circuit that receives an electric signal from the sensing means indicative of the temperature detected thereby, and in response to the received electric signal the electric circuit regulates the electric power supplied to the heating means from the generating means thereby controlling the heat supplied from the heating means to the cutting means such that the temperature of the cutting means is substantially maintained at a target level.

8. The shaving device of claim 7, further comprising:

temperature control means operative for a user to selectively set the target level as desired.

9. The shaving device of claim 2, wherein the power transfer means comprises:

a set of electrical contacts that join together to provide electrical communication between the heating means and the generating means when the head is attached to the handle.

10. A shaver comprising:

a razor blade that cuts hairs coming into contact therewith;

a heating element bonded to the razor blade, said heating element generating heat when an electric current is passed therethrough, said heat being supplied to the razor blade;

a battery that generates electric current;

electrical conductors through which electric current generated by the battery is routed to the heating element;

a handle adapted to be held by a user for manipulation of the shaver, said handle housing the battery; and, a head that houses the razor blade and the heating element bonded thereto, said head being selectively attachable to and detachable from the handle.

11. The shaver of claim 1, further comprising:

an indicator that provides a human perceivable indication of an amount of life remaining in the battery.

12. The shaver of claim 1, further comprising:

a sensor that detects a temperature of the razor blade.

13. The shaver of claim 12, further comprising:

a regulator that regulates the electric current supplied to the heating element from the battery based upon the temperature detected by the sensor.

14. The shaver of claim 1, further comprising:

a temperature controller by which a user selects a temperature setting for the razor blade.

15. A shaving device comprising:

a moving blade;

drive means for driving the moving blade;

an infrared heat source which selectively radiates infrared heat upon the cutting means; and, blade support means upon which the moving blade is supported, said blade support means carrying the infrared heat source.

16. The shaving device of claim 15, further comprising:

reflecting means for reflecting infrared heat from the infrared heat source toward the moving blade; and, an infrared absorbing coating applied to the moving blade.

* * * * *